US005230267A

United States Patent [19]

Abler

[11] Patent Number: 5,230,267

[45] Date of Patent: Jul. 27, 1993

[54] FOOD MATERIAL DECURLING APPARATUS AND METHOD

[75] Inventor: Norman C. Abler, Madison, Wis.

[73] Assignee: Oscar Mayer Foods Corporation, Madison, Wis.

[21] Appl. No.: 885,106

[22] Filed: May 18, 1992

[51] Int. Cl.[5] ..... B26D 7/32

[52] U.S. Cl. ..... 83/23; 83/100; 83/155; 83/165; 83/703; 83/932; 83/409.2; 426/518

[58] Field of Search ..... 83/163, 165, 23, 411.2, 83/490.2, 932, 730, 713, 703, 156, 155.1, 152, 99, 100, 856, 155, 162, 166; 426/518, 420

[56] References Cited

U.S. PATENT DOCUMENTS

| | | | |
|---|---|---|---|
| 3,851,554 | 12/1974 | Papai | 83/409.2 X |
| 4,270,910 | 6/1981 | Himmelsbach | 83/152 X |
| 4,436,012 | 8/1984 | Hochanadel | 83/703 |
| 4,586,409 | 5/1986 | Kuchler | 83/155 X |
| 4,906,025 | 10/1990 | Fitch | 83/703 |
| 4,987,809 | 1/1991 | Price | 83/156 X |
| 5,051,268 | 9/1991 | Mally | 426/420 |
| 5,149,554 | 9/1992 | Abler | 426/420 |

FOREIGN PATENT DOCUMENTS

| | | | |
|---|---|---|---|
| 655381 | 1/1938 | Fed. Rep. of Germany | 83/155.1 |

*Primary Examiner*—Douglas D. Watts
*Assistant Examiner*—Rinaldi Rada
*Attorney, Agent, or Firm*—Lockwood, Alex, FitzGibbon & Cummings

[57] ABSTRACT

An apparatus for decurling food material, such as slices severed from a food material supply , while the slices are being moved toward a transfer member includes a constriction positioned in close proximity to the slicing station and in general alignment therewith. The constriction is defined by opposing upper and lower surfaces; the upper surface is a stationary surface while the lower surface is a moving surface. The lower moving surface utilizes a plurality of flexible bands rotating around two driven rollers, which are disposed proximate to the food material supply. The bands which form the lower moving surface are driven at a speed equal to or greater than the speed at which the slicer operates.

23 Claims, 3 Drawing Sheets

FOOD MATERIAL DECURLING APPARATUS AND METHOD

BACKGROUND AND SUMMARY OF THE INVENTION

The present invention relates generally to the slicing of food materials, and more particularly to an apparatus for use in conjunction with food material slicing which apparatus substantially prevents the curling of food material slices during the slicing thereof.

Automated slicing is commonly used in the processing of various food materials. In some slicing applications, a food material supply is held in a magazine which, is repeatedly moved through a fixed slicing zone against a knife to successively obtain a series of slices from the food material. Typically in such slicing application, the movement of the food material supply magazine against the knife has a reciprocating or oscillating cycle wherein each cycle produces a food material slice during forward movement of the food material supply against the knife. Often the slices are obtained in such slicers by "throwing or ejecting" them onto a transfer surface during completion of the slicing movement. The transfer surface may include a food material packaging tray or it may include a surface such as a food transfer conveyor.

Curling of the food material slice is a problem which occurs with food slicers of the type described above. Quite often the curling which occurs may be exacerbated by the temperature of the food material supply. If the food material supply is somewhat frozen, the food material slice curls excessively as it is sliced because of the low temperature of the food material, much like a wood chip obtained from a carpenter's plane. However, where the food material is too warm, energy is imparted to the food material slice during the slicing process which warms the surfaces of the slice which may cause it to become tacky and partially adhesive in nature whereupon it has a high probability of adhering to the surfaces it contacts such as the slicing knife and or transfer assembly. Accordingly, a range of desired temperature exists at which the tendency of a food material slice to curl or adhere to processing components is tolerable. However, even within this range, curling nevertheless occurs. The curling which occurs may detrimentally affect the ability of the slice transfer or knife components, to properly convey the food material slices. Where a vacuum-assist transfer component located adjacent the slicing knife is not used, the curl of the slice may detrimentally affect the trajectory of the slice as it is sliced and hurled onto a transfer component.

The curling of such food material slices may affect other components in the food material production line. For example, in slicing assemblies which utilize a vacuum assist transfer apparatus such as is described in assignee's commonly owned U.S. Pat. No. 5,051,268, issued Sep. 24, 1991, the food material slice sometimes curls to the extent that the ability of the vacuum transfer drum to securely hold the slice on the outer surface thereof is impaired. Because the slice is not securely held, the ability of such a transfer system to eject the slice using pressurized air is also impaired.

Some attempts at removing the curl from such food material slices have involved the use of a passive, fixed constriction formed by positioning two spaced-apart, stationary surfaces closely to the knife to define a constricted opening between them through which the food material slice passes on its way to a take-off conveyor or other processing component. Such devices have limited success in removing slice curl and possess their own inherent problems. Some of these problems stem from the movement of the slice through the stationary surfaces forming the opening. Such movement generates frictional forces which are transferred to the slice. Due to the positioning of this constriction, the leading edge of the food material slice typically contacts the lower fixed surface and imparts a frictional force thereto. Additionally, a gravitational force is also exerted upon the severed food material slice which is cumulative to the frictional forces described above.

The present invention is thus directed to a device which overcomes the aforementioned disadvantages and provides an apparatus which enables a substantial increase in slicing speed to be achieved in an associated slicing assembly. The present invention provides a constriction located in close proximity to the slicing assembly having a moving lower surface which moves at a speed at least equal to the speed at which the slices are being sliced from the food material supply. As mentioned above, because this lower surface exerts the most influence on the food material slice movement and the provision of a moving surface is part of the constriction, individual successive food material slices are uncurled without significantly altering their course of movement through the constriction.

The invention further includes a planar slice thickness plate having a series of grooves which accommodate an equal number of elastic bands or flexible belts. The bands preferably interconnect two rollers and travel around them. The leading edge of the plate includes a rounded surface to prevent chafing of the belt as it travels between the rollers. This leading edge further provides a change in direction of the bands to position the moving lower surface of the constriction a preselected distance away from the portion of the knife assembly which serves as the fixed upper surface of the constriction. The bands serve to direct the slice(s) onto a suitable transfer roller for transfer to another work station on the production line.

Accordingly, it is an object of the present invention to provide a device for flattening or otherwise straightening a slice of food material freshly cut from a food material supply.

Another object of the present invention is to provide a food slice decurling device particularly suitable for use with a food material slicing apparatus in which a food material supply is reciprocatably moved through a food slicing zone, whereby movement of the food material supply in one direction causes the food material supply to contact a cutting edge and to produce a slice of food material and, wherein the decurling device includes a constriction positioned proximate to the slicing apparatus knife edge, the constriction having a first stationary surface forming the upper portion of the constriction and a second, moving surface forming the lower portion of the constriction.

Yet another object of the present invention is to provide an apparatus for removing the curl from successive slices of food material sliced from a food material supply wherein the apparatus includes a moving surface provided proximate to a slicing knife, the moving surface being formed by a plurality of moving elements, such as elastic bands, the bands forming the lower surface of a constriction disposed proximate to the slicer and further moving at a speed nominally equal to or greater than the speed at which slices are made from the food material supply.

These and other objects, features and advantages of the present invention will become more readily apparent from a reading of the following detailed description taken in conjunction with the accompanying drawings wherein like reference numeral refer to like parts.

BRIEF DESCRIPTION OF THE DRAWINGS

In the course of this detailed description, reference will be made to the attached drawings in which.

FIG. I illustrates a food slice decurling device, in section, constructed in accordance with the principles of the present invention.

DETAILED DESCRIPTION OF THE PREFERRED EMBODIMENTS

Figure 1:
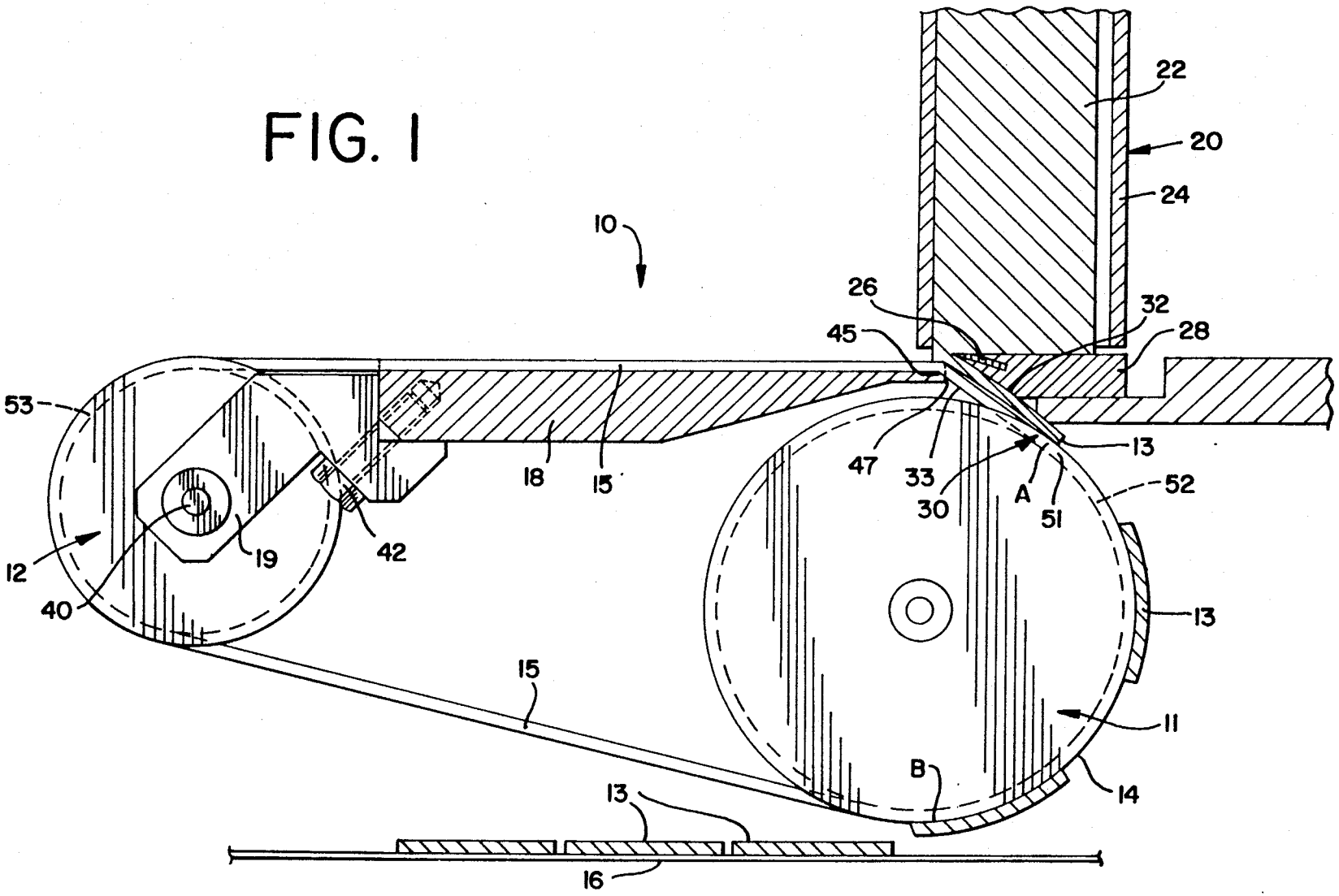

FIGS. I and 2 illustrate a food decurling device 10 constructed in accordance with the principles of the present invention. The device 10 is shown in conjunction with a conventional slicer assembly 20 particularly suitable for successively slicing slices from a food material supply 22, such as bacon. The food material 22 is held within a magazine 24 which reciprocates or oscillates back and forth in the manner shown in FIG. 1 such that the food material supply 22 is brought into contact with a stationary slicing knife 26 during movement of the food material supply 22 in the same direction (shown as to the right in FIG. 1.). The knife 26 is maintained within a knife holder 28 positioned generally underneath the food material supply magazine 24 and in close proximity thereto. Such a slicing assembly 20 is commonly used in the art and is known as a "Grote" slicer. The plate 18 is adjustable and accordingly may be moved within a range of distances away from the knife 26 to select the desired final thickness of the food material slice 13 severed from the food material supply 22.

The decurling device 10 of FIG. 1 includes, as shown, a pair of rollers 11, 12 which are located beneath the slicer assembly 20. One roller 11 is positioned directly beneath the food material supply 22 and receives the severed food material slice 13 upon its outer surface 14 after slicing. The construction of the roller 11 may be patterned after the roller construction explained in applicant's application Ser. No. 690,481, filed Apr. 24, 1991, now U.S. Pat. No. 5,149,554 the disclosure thereof being incorporated herein by reference. The roller 11 is driven by any suitable means such as a belt drive or gear drive. As explained in said U.S. Pat. No. 5,149,554, the roller 11 has a outer surface 14 which rotates over an inner drum (not shown). A pneumatic conduit, also not shown, supplies negative air pressure to both the inner drum and the outer roller 11 to provide a vacuum to the outer roller surface 14, whereby the food material slice 13 is adhered thereto at point A (FIG. 1), the point of tangency between flexible bands 15 and the roller 11, after it is sliced. The food material slice 13 adheres to the roller 11 until it approaches point B (FIG. 1) where positive air pressure is provided to the outer surface 14 through a series of apertures (not shown) to urge the food material slice 13 off of the roller 11 and onto a suitable transfer component, such as the conveyor 16 illustrated.

Figure 2:
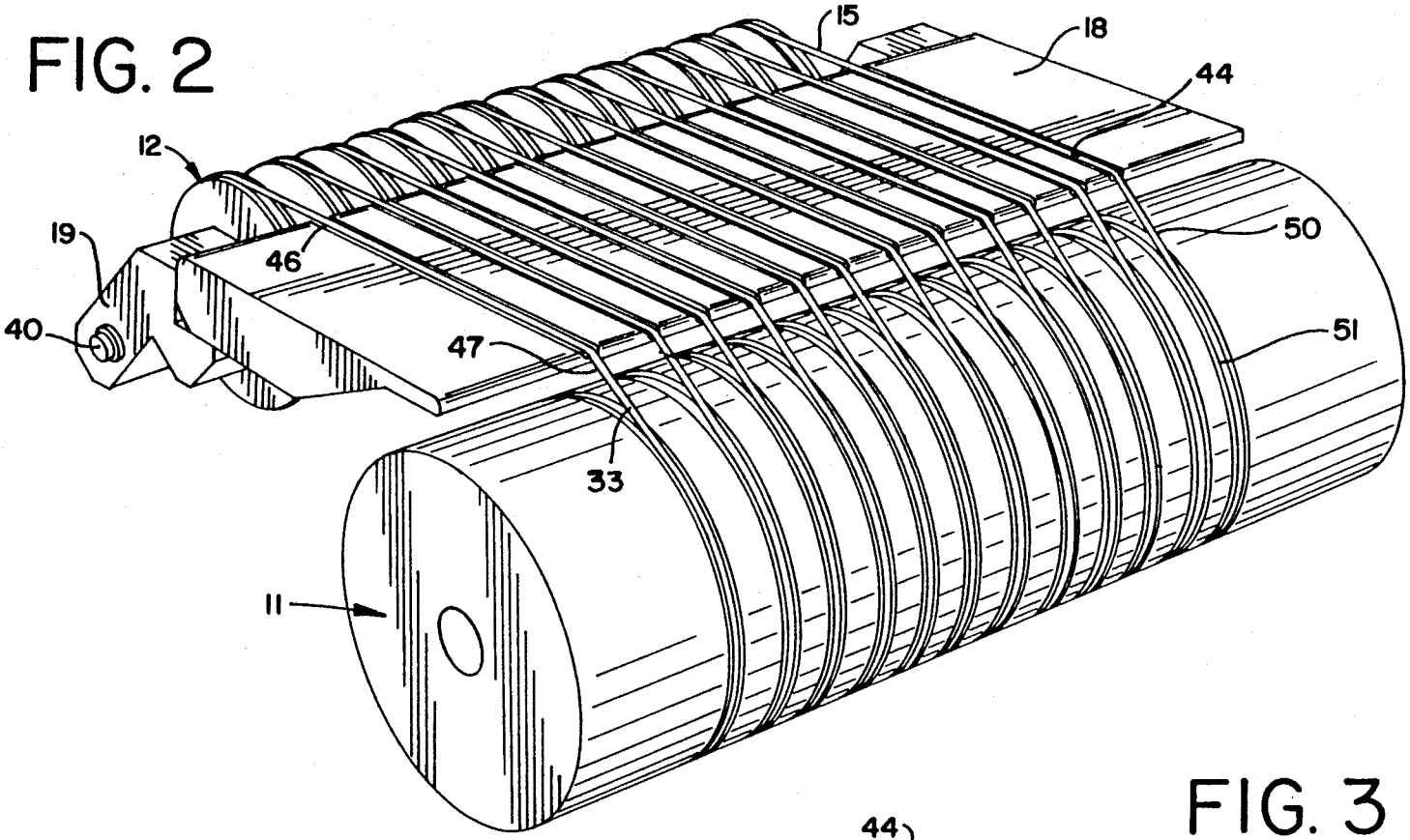
FIG. 2 illustrates a perspective view of the food slice decurling device of FIG. 1.

The roller 11 is interconnected with an idler roller 12 by a series of elastic bands, or flexible belts 15 which encircle both rollers and cause the idler roller 12 to be driven by the movement of roller 11. The bands 15 are partially supported in their extent between the rollers 11, 12 by a generally planar member, shown as plate 18, which is held in its position relative to the bands 15 by a pair of brackets, not shown, or other suitable means. This plate 18, not only (as explained below) guides the elastic bands 15 in their movement, but also serves to determine the thickness of the food material slice 13 as is the case with a conventional Grote slicer. As such, the plate 18 is adjustable in the vertical direction as shown in FIG. 1. The idler roller 12 is in turn, supported by a pair of brackets 19 extending out from the idler roller shaft 40 and engaging the plate 18 by means of a suitable connection, such as fastener 42. As best illustrated in FIG. 2, the plate 18 has a plurality of grooves, or channels 44, formed therein in a lengthwise direction. Each groove 44 accommodates an associated band 15 therein and preferably guides it in a first direction, or path, and further maintains the band 15 in alignment with a series of grooves 52 and 53 located in the respective roller 11 and idler roller 12. Each groove 44 has its leading and trailing edges 45, 46, respectively modified to present a rounded surface, or profile 47, to prevent chafing of the bands 15 during operation. Additionally, the profile 47 of the leading edge 45 of the plate 18 is positioned preferably away from and above the roller 11 such that the leading edge 45 causes the bands 15 to move along a second path from the plate 18 to the roller 11.

In an important aspect of the present invention and as best seen in the right-hand position of FIG. 1, a constriction assembly 30 is located proximate to the slicing knife 26 and the roller 11. This constriction 30 is defined by two spaced-apart surfaces 32, 33. The first of these two surfaces, is a stationary surface 32 which may either be generally planar or slightly curved and is defined by a portion of the knife holder 28. This stationary surface 32 defines the upper surface of the constriction 30. The second of these two surfaces is a moving surface 33 which is defined by the elastic bands 15 and in particular, by the portion 50 of each of the bands 15 which extend between the leading edges 45 of each plate groove 44 and the point of tangency 51 (shown at "A" in FIG. 1) of the grooves 52 present in the roller 11. This moving surface 33 defines the lower surface of the constriction 30 and may be generally parallel to the upper surface 32. The grooves 44 of the plate 18 accommodate the passage of the bands 15 into the cutting zone present beneath the slicing knife 26 without interfering with the food material supply 22.

Figure 3:
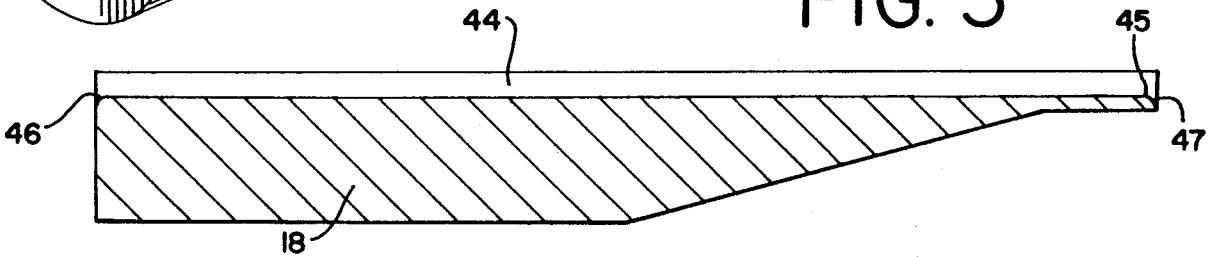
FIG. 3 illustrates a sectional view of the plate extruding between the two rollers of FIG. 1; and, FIG. 4 illustrates, in section, another embodiment of a food slice decurling device constructed in accordance with the principles of the present invention.

In operation, the roller 11 is indexed proximate to the food material supply 22. As the food material supply magazine 24 sweeps past the slicing knife 26 on its forward cutting cycle a slice 13 is severed from the food material supply 22. The slice 13 is carried through the constriction 30 by the moving, lower surface 33 of the constriction 30. Any tendency for the slice 13 to form a downward curl is removed by the speed at which the bands 15 rotate which, in the embodiment shown in FIGS. 1-3, is at least nominally equal to the speed of the slicing knife 26. The bands 15 thus exert an uncurling influence on the slices 13 without detrimentally altering their movement through the constriction 30. The slices 13 are adhered to the roller outer surface 14 by the internal vacuum and are carried through a predesired arc length and deposited near point B onto a transfer member 13.

Figure 4:
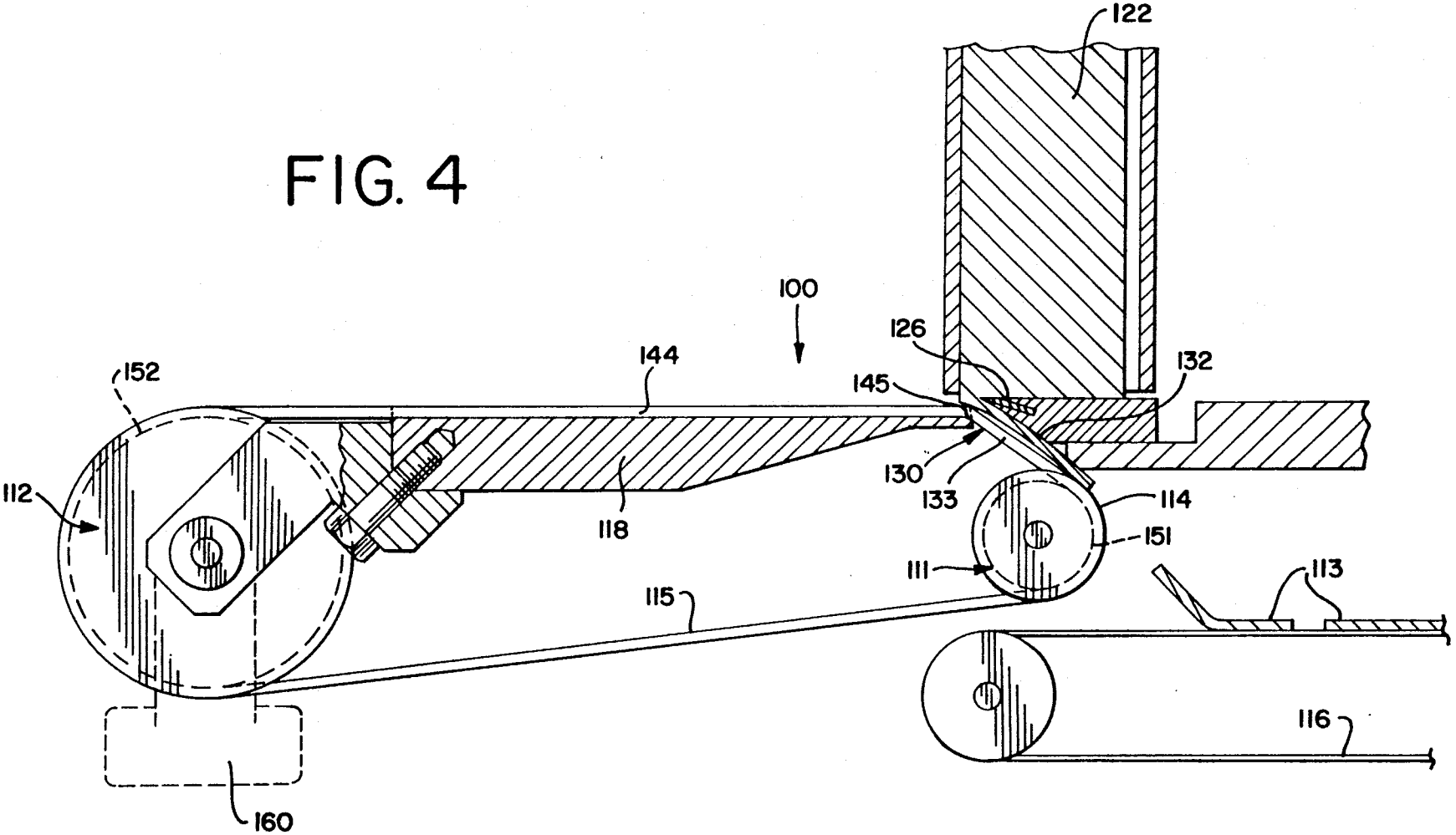

Turning now to FIG. 4, a second embodiment 100 of a food material slice decurling apparatus is shown in which the severed food material slice 113 is thrown from the cutting zone to a receiving conveyor 116. Similar to the embodiment of FIGS. 1–3, the apparatus 100 includes two-rollers 111, 112 spaced apart from each other and interconnected by a plurality of elastic bands 115 held within grooves 151, 152 of the rollers 111, 112. The band 115 are directed toward the food material supply 122 by a plate member 118 and traverse the length of the plate 118 through a plurality of spaced-apart grooves 144. At the leading edge 145 of the plate 118, the bands 115 are angled downwardly toward the roller 111.

The bands 115 define a moving, lower surface 133 spaced apart from a stationary, upper surface 132 and together they define a constriction 130 through which the slice 113 must pass. Because the roller 111 has no internal vacuum system, or other means by which to adhere slices 113 to its outer surface 114, the slices 113 are thrown through the airspace separating the roller 111 and the receiving conveyor 116 by a combination of the force imparted thereto by the slicing knife 126 and the movement of the bands 115. Either of the two rollers 111, 112 may be driven to control the speed of the bands 115, and hence, the moving surface 133. The drive mechanism 160 of the apparatus 100 may be indexed or otherwise connected to the slicing assembly to move at either about the same speed therewith or greater.

It will be seen that while certain embodiments of the present invention have been shown and described, it will be obvious to those skilled in the art that changes and modifications may be made therein without departing from the true spirit and scope of the inventions.

I claim:

1. A method of reducing the curl imparted to successive, individual food material slices severed from a moveable food material supply, comprising the steps of;

feeding a supply of a food material into a movable food material supply magazine;

moving the food material supply magazine toward a slicing knife so that a portion of said food material supply contacts said slicing knife and causes a food material slice to be severed from said food material supply;

providing a constriction near said slicing knife, the constriction having opposing first and second surfaces, said second surface of said constriction being a movable surface;

depositing said severed food material slice on said second surface after severing the same from said food material supply;

moving said severed food material slice through said constriction by moving said second surface in the same direction as said food material supply magazine during severing of said food material slice from said food material supply; and, contacting said food material slice with said stationary surface while moving said food material slice through said constriction to remove any curl present in said food material slice.

2. The method of claim 1, wherein said moving surface includes a plurality of flexible bands extending around two rollers, at least a portion of said flexible bands being positioned generally parallel to and spaced apart from said first surface.

3. The method of claim 2, further including the steps of guiding said flexible bands in a first direction until said flexible bands are proximate to said slicing knife and then subsequently guiding said flexible bands in a second direction, angularly offset from said first direction.

4. The method of claim 3, further the step of providing a guide plate having a series of grooves defined therein and passing said flexible bands through said grooves, said guide plate guiding said flexible bands in said first direction, said guide plate further having a leading edge which guides said flexible bands in said second direction.

5. An apparatus for decurling successive slices of a food material which slices are severed from a food material supply by a slicing knife and are subsequently deposited on a support surface, the apparatus comprising:

a stationary surface disposed proximate to the slicing knife, a moving surface disposed proximate to said slicing knife, the stationary and moving surfaces defining a constriction therebetween through which a food material slice is passed after the slice is severed from said food material supply, said moving surface causing said slice to contact said stationary surface while passing through said constriction, said food material supply being mounted within a magazine member which reciprocates in opposite first and second directions, said food material supply contacting said slicing knife when said magazine member moves in said first direction, said apparatus moving surface also moving in said first direction.

6. The apparatus of claim 5, wherein the moving surface includes a pair of rollers interconnected by a plurality of flexible bands.

7. The apparatus of claim 6, further including a generally planar guide plate disposed between said pair of rollers, said guide plate including a plurality of grooves corresponding in number to said plurality of flexible bands, said grooves being formed in a surface of said guide plate and said flexible bands extending longitudinally through said guide plate grooves.

8. The apparatus of claim 7, wherein said guide plate further includes a leading edge disposed at one end thereof, the guide plate leading edge being spaced apart from an outer surface of one of said rollers, said moving surface being defined by said flexible bands from between said guide plate leading edge to said one roller outer surface.

9. The apparatus of claim 5, wherein said support surface includes a transfer conveyor.

10. The apparatus of claim 5, further including a first and second roller spaced apart from each other and disposed proximate to said slicing knife, one of said first and second rollers being driven by drive means, said rollers being interconnected by a plurality of flexible bands, the bands forming said moving surface of said constriction and said flexible bands further driving a remaining roller of said first and second rollers, a generally planar guide plate disposed between said first and second rollers, said guide plate including a plurality of grooves formed in a surface thereof, the grooves extending between said first and second rollers, each of the grooves containing at least one of said plurality of flexible bands therein, said guide plate including a leading edge at one end thereof and spaced apart from an outer surface of said first roller, said moving surface being defined by a portion of said flexible bands extending between said guide plate leading edge and said first roller outer surface.

11. The apparatus of claim 5, wherein said moving surface is defined by first and second rotating members and a plurality of flexible bands drivingly interconnecting the rotating members, the first rotating member having a generally cylindrical outer surface with a plurality of circumferential channels disposed therein, each of said first rotating member circumferential channels containing a flexible band therein, each of the flexible bands being guided around said first and second rotating members in a first rotational path by a guide plate interposed between said first and second rotating members, said guide plate further having a leading edge positioned adjacent said first rotating member, said guide plate leading edge guiding said flexible bands in a second rotational path.

12. The apparatus of claim 11, wherein said flexible bands second rotational path is angularly offset from said first rotational path.

13. The apparatus of claim 11, wherein said flexible bands second rotational path extends downwardly relative to said first rotational path.

14. The apparatus of claim 5, wherein said moving surface moves at a speed at least equal to a speed at which said food material slices are sliced from said food material supply.

15. A machine for substantially removing any curl imparted to individual slices of a food material sliced from a food material supply and subsequently transferred onto a product support member, comprising, in combination:

a food material supply member engaging a food material supply, the food material supply member being capable of movement back and forth, defining a food slicing direction and a return direction, a stationary slicing knife interposed in a path of said food material supply member, the slicing knife being contacted by said food material supply when said food material supply member moves in the food slicing direction, and a constriction disposed adjacent said slicing knife, the constriction being formed by opposing first and second surfaces, the first surface being a stationary surface and the second surface being a moving surface which moves in said food slicing direction, the moving surface being formed by a plurality of flexible bands drivingly engaging two spaced-apart rollers, the flexible bands moving around said two rollers in response to driving movement of at least one of said two rollers, a first of said two rollers being disposed proximate to said slicing knife, the first roller having a plurality of circumferential grooves disposed in an outer surface thereof, the device further including a generally planar member positioned proximate to said first roller, the planar member including a plurality of longitudinal grooves disposed in a surface thereof, each of the longitudinal grooves having one of said plurality of flexible bands disposed therein, said longitudinal grooves guiding said flexible bands in movement along a first path, said planar member including a first edge disposed proximate to said first roller and spaced apart therefrom, the planar member first edge further guiding said flexible bands in rotational movement along a second path, whereby a food material slice deposited on said moving surface contacts said stationary surface, said second path being generally parallel to said stationary surface.

16. The machine of claim 15, wherein said second path is angularly offset from said first path.

17. The machine of claim 15, wherein said constriction stationary surface is generally planar.

18. The machine of claim 15, wherein said flexible bands are driven at a speed at least equal to a slicing speed.

19. The machine of claim 15, wherein said planar member is disposed above said one roller.

20. The machine of claim 15, wherein said constriction stationary surface is formed by at least a portion of said slicing knife.

21. An apparatus for substantially removing the curl from individual, successive meat product slices severed by a slicing knife from a meat product supply, comprising:

a first roller having an elongated, generally cylindrical outer surface, the first roller outer surface having a plurality of circumferential grooves disposed therein, a second roller spaced apart from said first roller, a plurality of elastic belts disposed in said first roller circumferential grooves, the elastic belts drivingly engaging said first and second rollers such that rotational movement of one of said first and second rollers imparts a like rotational movement to the remaining roller of said first and second rollers, said elastic belts defining a moving surface of said apparatus, said apparatus further including a stationary surface spaced apart from said moving surface, said stationary and moving surfaces together forming a constriction through which said moving surface carries a severed meat product slice to thereby bring said meat product slice in contact with said stationary surface to remove any curl present therein.

22. An apparatus for decurling successive slices of a food material which slices are severed from a food material supply by a slicing knife and are subsequently deposited on a support surface, the apparatus comprising:

a stationary surface disposed proximate to the slicing knife, a moving surface disposed proximate to said slicing knife, the stationary and moving surfaces defining a constriction therebetween through which a food material slice is passed after the slice is severed from said food material supply, said moving surface causing said slice to contact said stationary surface while passing through said constriction, wherein the moving surface includes a pair of rollers interconnected by a plurality of flexible bands, the apparatus further including a generally planar guide plate disposed between said pair of rollers, said guide plate including a plurality of grooves corresponding in number to said plurality of flexible bands, said grooves being formed in a surface of said guide plate and said flexible bands extending longitudinally through said guide plate grooves.

23. An apparatus for decurling successive slices of a food material which slices are severed from a food material supply by a slicing knife and are subsequently deposited on a support surface, the apparatus comprising:

a stationary surface disposed proximate to the slicing knife, a moving surface disposed proximate to said slicing knife, the stationary and moving surfaces defining a constriction therebetween through which a food material slice is passed after the slice is severed from said food material supply, said moving surface causing said slice to contact said stationary surface while passing through said constriction, the apparatus, further including a first and second roller spaced apart from each other and disposed proximate to said slicing knife, one of said first and second rollers being driven by drive means, said rollers being interconnected by a plurality of flexible bands, the bands forming said moving surface of said constriction and said flexible bands further driving a remaining roller of said first and second rollers, a generally planar guide plate disposed between said first and second rollers, said guide plate including a plurality of grooves formed in a surface thereof, the grooves extending between said first and second rollers, each of the grooves containing at least one of said plurality of flexible bands therein, said guide plate including a leading edge at one end thereof and spaced apart from an outer surface of said first roller, said moving surface being defined by a portion of said flexible bands extending between said guide plate leading edge and said first roller outer surface.

* * * * *